US006029807A

United States Patent [19]

Love

[11] Patent Number: 6,029,807

[45] Date of Patent: Feb. 29, 2000

[54] SECURITY CASE WITH STRESS CONTOUR FOR COLLECTIBLE ITEMS

[75] Inventor: Keith D. Love, Denver, Colo.

[73] Assignee: Independent Rare Coin Auditors LLC, Englewood, Colo.

[21] Appl. No.: 09/222,077

[22] Filed: Dec. 29, 1998

[51] Int. Cl.[7] ..... A45C 1/00; B65D 85/00; B65D 8/22

[52] U.S. Cl. ..... 206/82; 206/459.1; 206/807; 220/4.21

[58] Field of Search ..... 206/8, 81, 82, 206/6.1, 807, 459.1; 220/4.21, 4.24

[56] References Cited

U.S. PATENT DOCUMENTS

| | | | |
|---|---|---|---|
| 3,139,977 | 7/1964 | Burdick | 206/81 X |
| 4,197,947 | 4/1980 | Zaidi | 206/807 X |
| 4,489,841 | 12/1984 | Thompson | 206/459.1 X |
| 4,678,083 | 7/1987 | Anderson | 206/459.1 X |
| 4,762,248 | 8/1988 | Uhliq | 220/783 X |
| 4,878,579 | 11/1989 | Hager . | |
| 4,915,214 | 4/1990 | Wieder | 206/82 |
| 4,979,619 | 12/1990 | Hager . | |
| 5,011,005 | 4/1991 | Boyd et al. | 206/81 |
| 5,040,671 | 8/1991 | Hager . | |
| 5,042,650 | 8/1991 | Mayer et al. . | |
| 5,109,977 | 5/1992 | Mayer et al. . | |

*Primary Examiner*—Bryon P. Gehman

*Attorney, Agent, or Firm*—Stuart Langley Holland & Hart LLP

[57] ABSTRACT

A security package for a collectible item including a substantially planar bottom portion having a retainer for holding the collectible item. An edge with a lower sealing contour is formed in the planar bottom. A substantially planar top portion has an edge with an upper sealing contour formed therein. The upper sealing contour is designed to mate with the lower sealing contour. A seal is formed by welding the upper and lower sealing contours. A stress contour is formed integrally with at least one of bottom or top portions. The stress contour operates to cause a permanent perceptible distortion in the security package after stress is applied to the seal.

18 Claims, 2 Drawing Sheets

SECURITY CASE WITH STRESS CONTOUR FOR COLLECTIBLE ITEMS

BACKGROUND OF THE INVENTION

1. Field of the Invention

The present invention relates, in general, to collectable items, and, more particularly, to a security case for storing and protecting collectible items.

2. Relevant Background

There is a growing market for collectible items throughout the world. An increasing portion of this market is the result of speculators that buy and sell collectible items in an effort to profit from changes in value. Example collectibles include baseball cards, stamps, coins, jewelry and the like. When a valuable collectible item is sold it is often difficult for the buyer and seller to demonstrate the value of the item.

The value of a particular item is determined not only by the type of item (e.g., the year and mint of a coin), but also by the condition and quality of the specimen. Oftentimes collectors, although more or less knowledgeable about the type of the item are nevertheless unable to accurately judge the condition, quality, or other subjective features of the item. This is particularly true in the case of a buy/sell transaction where neither party can make a disinterested evaluation of these factors.

To meet this need, collectors often rely on third party independent grading services. These services employ experts in the particular field that know a great deal about the factors that go into making the subjective judgement about quality and condition. Ideally these services are truly independent of the collectors or speculators so that their judgement is not biased.

After verifying the authenticity and quality of a collectible item, grading services often package and seal the item in a special casing that enables the item to be viewed, but protects the item from environmental stress that might degrade the quality of the specimen. For example, coin grading services package coins in sealed plastic containers called "slabs" formed from two plastic plates that are sealed together. The coin and certificate of authenticity and quality are sandwiched between the two plates so as to display both sides of the coin but protect against subsequent degradation. This package allows the coin(s) to be easily stored and cataloged. Most importantly, the sealed package is intended to ensure the authenticity of the grading services certification. So long as the package remains sealed, a purchaser can be confident that the coin inside the package is the same coin that was certified by the grading service.

Unfortunately, unscrupulous individuals can break into the sealed containers of the prior art, change the coin, and reseal the package to appear as new. This not only misleads potential buyers, but also destroys the reputation of the coin grading service. Efforts have been made to prevent such tampering by using, for example, thin holograms that are attached to the packaging with the intention that the hologram will be destroyed if the package is tampered with. However, some existing slab designs are so readily opened that these types of security seals are not disturbed. Moreover, these type security devices are becoming easier to counterfeit. A need exists for a collectible packaging system and method that discourages tampering by indicating when a sealed package has been reopened.

SUMMARY OF THE INVENTION

Briefly stated, the present invention involves a security package for a collectible item including a substantially planar bottom portion having a retainer for holding the collectible item. An edge with a lower sealing contour is formed in the planar bottom. A substantially planar top portion has an edge with an upper sealing contour formed therein. The upper sealing contour is designed to mate with the lower sealing contour. A seal is formed by welding the upper and lower sealing contours. A stress contour is formed integrally with at least one of bottom or top portions. The stress contour operates to cause a permanent perceptible distortion in the security package after stress is applied to the seal.

DETAILED DESCRIPTION OF THE PREFERRED EMBODIMENTS

The particular embodiments of the present invention described herein relate to coin holders and in particular tamper proof coin holders used by coin graders to seal coins after grading and by coin collectors to store and identify coins in their collection. It should be understood, however, that the present invention is readily adapted for holding any type of collectible item, particularly flat collectible items such as coins, cards, jewels and jewelry, stamps, and the like. The present invention can be manufactured with using a wide variety of materials in addition to those specifically described herein. Further, the particular shapes and dimensions of the preferred embodiments disclosed herein are provided for example only except where otherwise noted.

Figure 1:
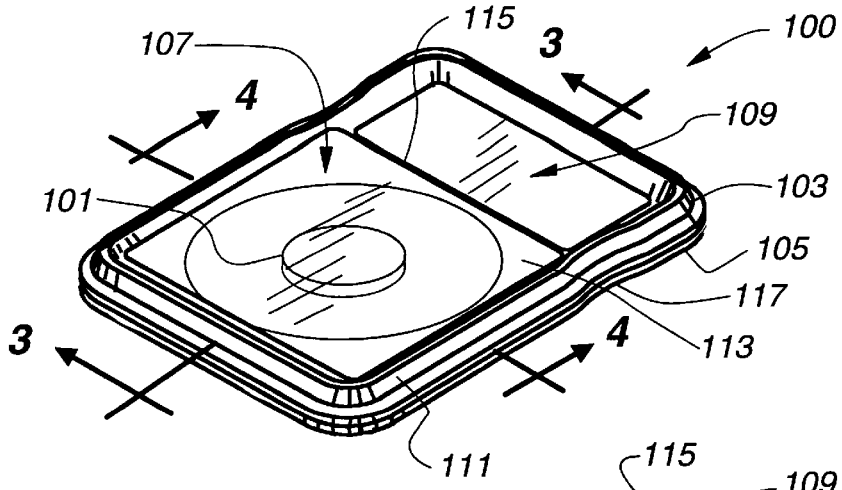
FIG. 1 shows a perspective view of an assembled security case in accordance with the present invention.

FIG. 1 shows a coin case 100 in accordance with a preferred embodiment of the present invention. Security case 100 holds a collectible item, for example, collectible coin 101. Security case 100 comprises an upper portion 103 and a lower portion 105 that are fitted together once coin 101 has been placed inside. Upper portion 103 and lower portion 105 have mating and interlocking joining surfaces or sealing contours that are ultrasonically welded to seal the security case 100. Desirably, weld promoting surface texture is formed on at least one of the upper and lower joining surfaces.

Upper portion 103 and lower portion 105 are generally rectangular in shape having sealing surfaces (described in greater detail hereinafter) located generally around the rectangular periphery of the portions, and in the particular example spaced in from the outermost edge of the case 100. Once sealed together security package 100 is a unitary assembly that includes a primary cavity 107 in which a retainer 113 (best seen in FIG. 2) is placed to hold coin 101. Security package 100 also includes a secondary cavity 109 for holding an authentication certificate or labels identifying the grading service, coin grade and type, and other indicia describing the item contained in the primary cavity.

Examples of such information include bar codes, printed labels, and the like.

A significant feature in accordance with the present invention is a stress contour 115 formed around the periphery of the primary cavity 107. Stress contour 115 in the preferred embodiment is integrally formed as a part of a view window defined in an upper surface of cavity 107. Stress contour 115 is positioned so that it is at all points less than a selected distance from a corresponding portion of the seal. By placing stress contour 115 close to the seal it serves to concentrate stress in an area about stress contour 115 in response to force applied in an effort to break open a sealed security case 100.

In operation, when an attempt is made to break the seal formed between upper portion 103 and lower portion 105 by applying force to the seal, stress is concentrated by stress contour 115 in a manner that causes a permanent perceptible change in security case 100. This change may be, for example, a cracking or splintering of the material. Less dramatically, stress contour 115 may cause a change in color such as from transparent to opaque making a readily perceptible indication that an attempt has been made to break open security case 100. Conversely, the lack of any perceptible distortion is a continuous indicator that there has been no attempt to break the seal.

Figure 2:
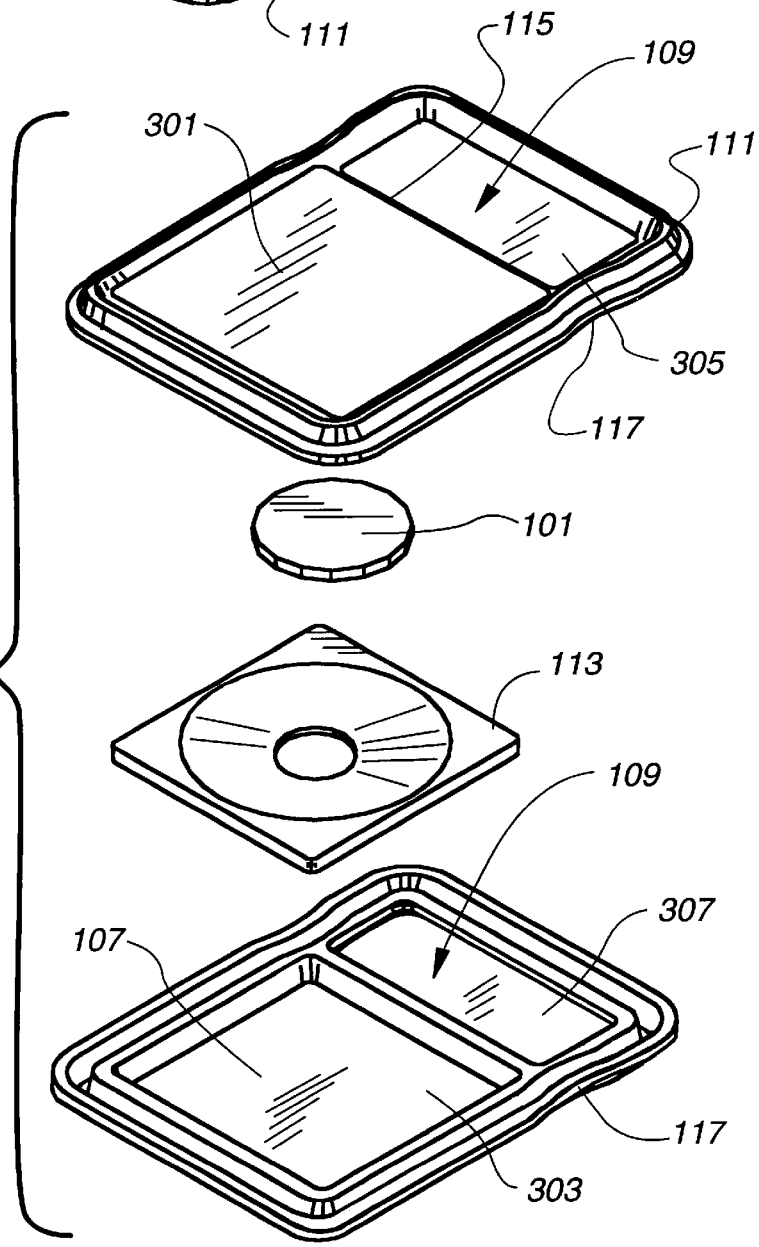
FIG. 2 shows an exploded view of the security case shown in FIG. 1.

FIG. 2 illustrates the component portions of security case 100 in an exploded view, making clear the assembly of security case 100. Lower portion 105 is conveniently formed as a separate piece from upper portion 103 and having mating sealing or joint surfaces formed about the periphery of each component. A retainer 113 comprises an elastomeric material such as urethane, silicone, and the like. The exterior shape of retainer 113 and is sized to fit snuggly into primary cavity 107 without adhesive. The interior dimensions of an opening in retainer 113 are chosen to fit the object being stored and can take on a variety of shapes in accordance with the present invention. In the particular example shown in FIG. 1 and FIG. 2, coin 101 is set on retainer 113. Preferably, the hole in the center of retainer 113 is cut out so that it is substantially the same size as coin 101. In this manner, both the front and back of the collectible item such as coin 101 can be viewed through the upper and lower view windows 301 and 303 of primary cavity 107.

Before sealing the certificate of authenticity (not shown), or labeling or other identifying material may be placed in secondary cavity 109. The components shown in FIG. 2 can be assembled manually or automatically joining the sealing surfaces of the upper and lower portions. After joining, a seal is formed by ultrasonic welding, for example, about the periphery. The weld must be formed in a manner that creates a seal of sufficient strength to resist attempts to break open the package. Stress contour 115 aids in this requirement by causing the package to distort in a permanently perceptible manner at a stress below that which would break the seal between the upper portion 103 and the lower portion 105. In this manner, by the time sufficient force is applied to break even a portion of the seal, security package 100 in accordance with the present invention will bear a permanent perceptible indication of the attempt to break the package 100.

Desirably, both the upper portion 103 and the lower portion 105 include stacking flanges such as stacking flange 111. The lower stacking flange is not visible in FIG. 1 or FIG. 2 but is substantially similar to stacking flange 111. Either the upper or the lower stacking flange 111 is spaced closer to the edge than the other stacking flange 111 to enable the upper flange 111 of a first security case 100 to securely and removable nest with the lower stacking flange 111 of a second security case 100. This feature enables a plurality of assembled security packages 100 to be stacked one atop another in an interlocking but removable fashion.

Another feature in accordance with the present invention is the inclusion of ornamental curves 117. These curves aid in making the security package 100 easily identifiable as compared to straight-sided security packages. On either the upper portion 103 or the lower portion 105 the stacking flanges may be omitted in the region about ornamental curve 117 to ease manufacturing as well as to ease alignment when the stacking feature is being used.

Figure 4:
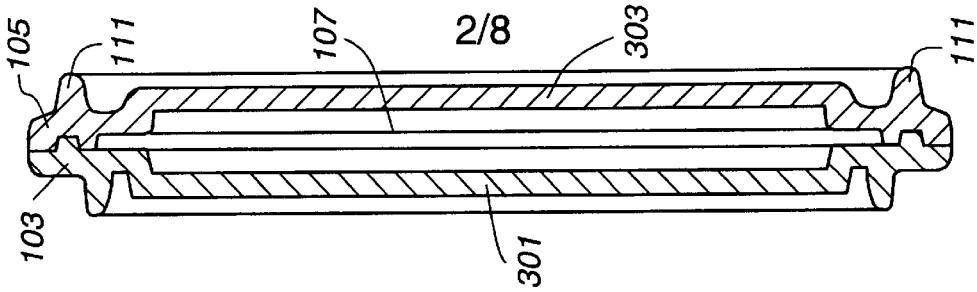
FIG. 4 illustrates a second cross-section view of a security case in accordance with the present invention taken orthogonally from the view of FIG. 3.
Figure 3:
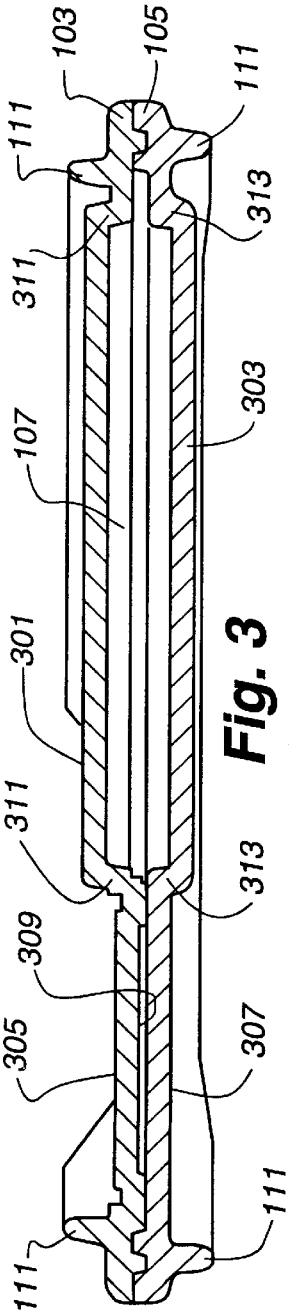
FIG. 3 illustrates a first cross-section view of a security case in accordance with the present invention.
Figure 5:
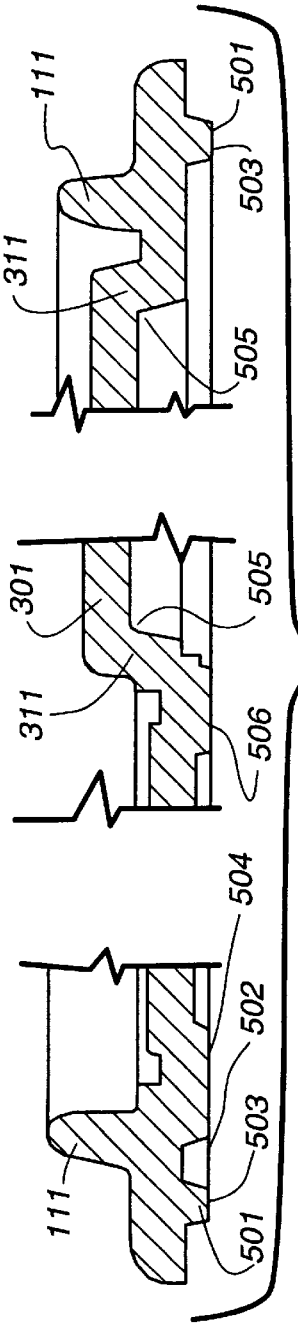
FIG. 5 shows a magnified view of a first portion of a security case in accordance with the present invention.
Figure 6:
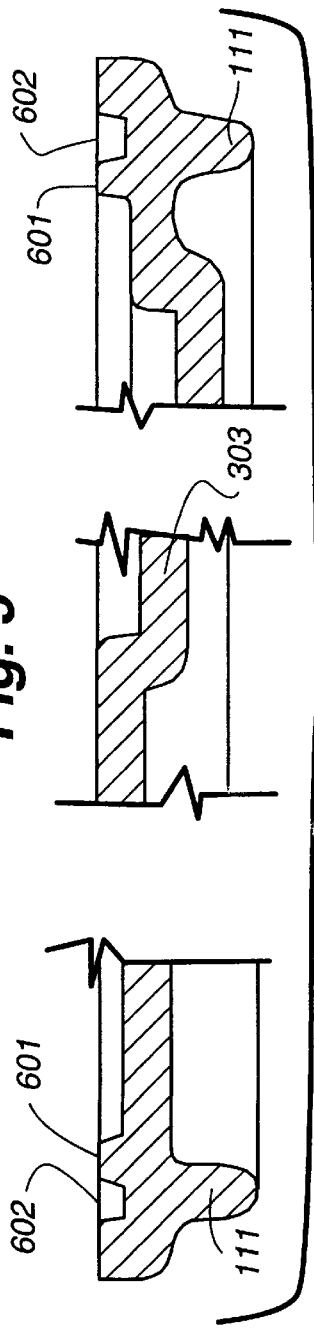
FIG. 6 shows a magnified view of a second portion of a security case in accordance with the present invention.

FIG. 3–FIG. 5 illustrate the joining features and stress contour features of the present invention in greater detail in cross-section form. FIG. 3 shows a cross-section taken through the section 3–3' shown in FIG. 1. Similarly, FIG. 4 illustrates a cross-section taken through the 4–4' line indicated in FIG. 1. FIG. 5 and FIG. 6 show magnified views of the edge or peripheral portion of the cross-sections shown in FIG. 3 and FIG. 4.

Referring to FIG. 3, it can be seen how the joint surfaces near the periphery of upper portion 103 and lower portion 105 join together to form a seal at the periphery of security package 100. Optionally, there can be a joint surface between primary cavity 107 and secondary cavity 109 although this is optional. Contents within primary cavity 107 can be viewed through view window 301 or view window 303 when upper and lower portions 103 and 105 comprise a transparent or at least substantially transparent material. Suitable materials include acrylic and styrene acrylonitrile (SAN) manufactured by a variety of plastic material providers. SAN resins are optically clear resins used in a variety of packaging applications. SAN is preferred over acrylic, general-purpose polystyrene or polycarbonate resins, because of its low unit cost, clarity, improved toughness and resistance to chemicals and heat. More generally, suitable materials exhibit an ability to be ultrasonically welded or equivalent, sufficient hardness to protect the contents held in primary cavity 107, moldability, and a brittleness sufficient to create a permanent perceptible distortion when force is applied.

Secondary window 109 can be viewed through view port 305 or rear view port 307. Primary view port 107 is formed by a side wall 311 that surrounds and defines primary cavity 107. Side wall 311 is formed at a relatively steep angle in accordance with the present invention to provide the stress contour 115 discussed before with reference to FIG. 1. Side wall 311 makes an abrupt angle with both view port 301 and a plane defined by the joining surfaces where upper portion 103 and lower portion 105 are joined. By an abrupt angle it is meant that the angle of incidence is in the range of 45–90° with minimal rounding of the corners to reduce stress. Corner rounding tends to distribute rather than concentrate stress. As seen in FIG. 3, some rounding of the corners is acceptable and in many manufacturing environments unavoidable. The rounding of the corners should be controlled so that they do not reduce the stress concentrating features of stress contour 115.

Similarly, on lower portion 105 a stress contour is formed by side walls 313 that surround lower view window 303. Side walls 313 also abruptly contact view port 303 although side walls 313 are formed integrally with view window 303. Side walls 313 also abruptly meet lower view window 307 as shown in FIG. 3. This abrupt meeting of side walls 311 and 313 results in a stress concentration at or about side walls 311 and 313 when force is applied to the sealed surfaces that join upper portion 103 and lower portion 105 together. In prior implementations, non-abrupt meeting angles were used in the order of 45° or less or rounded dome-shaped meeting contours were used for aesthetic purposes and to prevent breakage of the case. These efforts viewed case breakage as undesirable. Accordingly, they eliminated as many abrupt corners in the design as possible to enhance package integrity and resistance to breaking.

In contrast, the present invention employs these abrupt meeting angles to encourage distortion in the regions of stress contours 115. By encouraging this stress concentration a permanent perceptible distortion is created in the security package 100 at a much lower applied force as compared to the prior art. In operation the present invention is practically as strong as any prior casing but ensures that if a sufficient effort is made to break the seal the package will show the damage immediately.

FIG. 6 illustrates a magnified section from lower portion 105 illustrating the various contours of significance. The edges include downwardly extending stacking flanges 111 having a slightly larger diameter than upwardly extending stacking flanges 111 shown in FIG. 5. A wide variety of arrangements for stacking flanges 111 is possible and any available or conventional stacking flange design may be used.

On the joining surface of lower portion 105 an upwardly extending joint flange 601 and a joining groove 602 are formed. Joining groove 602 mates with joint flange 503 shown in FIG. 5. Joint flange 601 shown in FIG. 6 will mate with and join to joint groove 502 shown in FIG. 5. Additional joining surface can be formed such as shown by joining surface 504 that will abut and join with the upper surface of lower portion 105. A great deal of latitude is allowed in the exact dimensions and contours of these joining surfaces with the intended goal to make a secure, difficult-to-break seal for security package 100.

In a manner analogous to that described in FIG. 5, lower portion 105 includes similar side walls 613 that perform an analogous stress concentration function to side walls 311 shown in FIG. 5. It is only necessary to form side walls on either one of upper portion 103 and lower portion 105, however, providing them on both portions increases the likelihood that an unacceptable force applied to the seal will cause a perceptible distortion in the security package 100. As discussed herein before, the abrupt meeting side wall is preferably at an angle of between 45° and 90° degrees to the plane of the lower view window 303 or the sealing surfaces of the joint between upper portion 103 and lower portion 105.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A security package for a collectible item comprising:

a substantially planar bottom portion having a retainer for holding the collectible item and having an edge with a lower sealing portion therein;

a substantially planar top portion having an edge with an upper sealing portion formed therein, wherein the upper sealing portion is designed to mate with the lower sealing portion;

a seal formed by welding the upper and lower sealing portion; and a stress contour formed separately from the seal and integrally with at least one of the bottom and the top portions, the stress contour operative to cause a permanent perceptible distortion in the security package after stress is applied to the seal.

2. The package of claim 1 further comprising a weld promoting surface texture formed on at least one of the upper and lower sealing portions.

3. The package of claim 1 wherein the distortion has a predictable pattern determined by the shape of the stress contour.

4. The package of claim 1 wherein the stress contour comprises a projection from the top portion having a sidewall meeting the upper portion substantially at an abrupt angle.

5. The package of claim 1 wherein the stress contour comprises a transparent plastic in an unstressed state and a comparatively opaque plastic in a stressed state.

6. The package of claim 1 wherein the stress contour comprises acrylic.

7. The package of claim 1 wherein the stress contour comprises styrene acrylonitrile.

8. The package of claim 1 wherein the stress contour is positioned so as to focus stress, strain and torsion induced deformation resulting from force applied to the seal in an area substantially about the stress contour.

9. The package of claim 1 wherein the stress contour is ring-shaped to surround the collectible item and positioned so that it is at all points less than a selected distance from a corresponding portion of the seal.

10. A method for grading a coin comprising the steps of:

judging the coin's quality;

providing a sealable security case sized to hold the coin;

providing a stress contour integrally with the sealable security case and separate from sealing surfaces of the security case;

placing the coin in the sealable security case at the sealing surfaces; and sealing the security case in a manner that applies sufficiently low force to the stress contour so as to prevent perceptibly altering the stress contour and in a manner that creates sufficient sealing so that the force required to break the seal will necessarily cause a perceptible alteration of the stress contour.

11. The method of claim 10 wherein the step of providing a stress contour comprises forming the stress contour integrally during the step of providing a security case.

12. The method of claim 10 wherein the step of providing a stress contour comprises forming a boss in the security case having sidewalls coupled to the security case at right angles.

13. The method of claim 12 wherein the boss forms a viewing window displaying the contents of the sealed security case.

14. The method of claim 10 wherein the security case and stress contour comprise a transparent plastic.

15. The method of claim 10 wherein the stress contour comprises acrylic.

16. The method of claim 10 wherein the stress contour comprises styrene acrylonitrile.

17. The method of claim 10 wherein the step of providing a stress contour comprises forming the stress contour so as to be substantially annular in shape having a continuous edge that is at any point within a predetermined distance of a corresponding portion of the seal.

18. A system for maintaining authenticity of a certificate of grading for a collectible item comprising:

a package having a breakable seal for holding the collectible item after it has been graded and certified;

a stress contour formed separately from the seal and integrated with the package and coupled to serve as a focus for force applied to break the seal, the stress contour producing a perceptible distortion upon application of a force of preselected magnitude to the seal;

means for storing the package, wherein the stress contour continuously indicates the authenticity of the collectible item held in the package.

* * * * *